US005983994A

United States Patent [19]

Tsou

[11] Patent Number: 5,983,994

[45] Date of Patent: Nov. 16, 1999

[54] METHOD AND APPARATUS FOR ON-LINE CLEANING OF AND IMPROVEMENT OF HEAT TRANSFER IN A HEAT EXCHANGER TUBE

[75] Inventor: John L. Tsou, Foster City, Calif.

[73] Assignee: Electric Power Research Institute, Inc., Palo Alto, Calif.

[21] Appl. No.: 08/961,760

[22] Filed: Oct. 30, 1997

[51] Int. Cl.[6] ..... F28G 1/08; F28F 13/12

[52] U.S. Cl. ..... 165/94; 165/95; 165/109.1; 15/104.16

[58] Field of Search ..... 165/94, 95, 109.1; 15/104.68, 104.69, 104.16; 138/38

[56] References Cited

U.S. PATENT DOCUMENTS

| | | | |
|---|---|---|---|
| 2,170,997 | 8/1939 | Griffin . | |
| 2,677,394 | 5/1954 | Brinen et al. | 165/109.1 X |
| 2,734,208 | 2/1956 | Griffin . | |
| 4,007,774 | 2/1977 | Withers . | |
| 4,073,339 | 2/1978 | D'Orsay . | |
| 4,174,750 | 11/1979 | Nichols . | |
| 4,213,178 | 7/1980 | Diez et al. . | |
| 4,258,782 | 3/1981 | Kao . | |
| 4,281,432 | 8/1981 | Saxon . | |
| 4,347,894 | 9/1982 | Gerlach . | |
| 4,545,426 | 10/1985 | Collins | 165/95 |
| 4,562,886 | 1/1986 | Holm . | |
| 4,718,480 | 1/1988 | Kito et al. | 165/94 X |
| 4,798,241 | 1/1989 | Jarrett et al. . | |
| 4,937,907 | 7/1990 | Antal . | |
| 5,153,963 | 10/1992 | Saxon et al. . | |
| 5,165,469 | 11/1992 | Smith . | |
| 5,311,929 | 5/1994 | Verret | 165/95 |
| 5,437,073 | 8/1995 | Smith . | |
| 5,448,795 | 9/1995 | Boughal . | |
| 5,473,787 | 12/1995 | Echols . | |
| 5,497,824 | 3/1996 | Rouf . | |
| 5,518,067 | 5/1996 | Finch et al. . | |
| 5,537,832 | 7/1996 | Keus | 165/94 X |
| 5,784,745 | 7/1998 | Saxon et al. | 15/104.16 X |

FOREIGN PATENT DOCUMENTS

| | | | |
|---|---|---|---|
| 105898 | 6/1985 | Japan | 165/94 |
| 617673 | 7/1978 | U.S.S.R. | 165/94 |

OTHER PUBLICATIONS

Garey, John F., et al, "The Cost–Effectiveness of Alternative Condenser Biofouling Control Methods," pp. 497–517, 1980, Ann Arbor, Michigan 48106.

*Primary Examiner*—Leonard Leo
*Attorney, Agent, or Firm*—Pennie & Edmonds LLP; David Owens

[57] ABSTRACT

A method and apparatus are described for cleaning the inside of a heat exchanger tube while the tube is in operation and for simultaneously enhancing the heat transfer rate across the tube wall. The method consists of positioning a rod containing a tube cleaner inside of the heat exchanger tube and moving the rod in a back and forth motion during operation of the heat exchanger tube. The tube cleaner is designed to scrape the inside wall of the heat exchanger tube and to create turbulence in the fluid near the tube wall thereby improving the heat transfer rate across the tube wall.

8 Claims, 3 Drawing Sheets

METHOD AND APPARATUS FOR ON-LINE CLEANING OF AND IMPROVEMENT OF HEAT TRANSFER IN A HEAT EXCHANGER TUBE

BACKGROUND OF THE INVENTION

1. Field of Invention

This invention relates generally to cleaning of heat exchanger tubes. More particularly, this invention relates to the on-line cleaning of a heat exchanger tube and simultaneous improvement of the heat transfer rate across the tube wall.

2. Description of the Related Art

It is well know that the performance of a heat exchanger tube, and therefore the heat exchanger itself, is reduced due to the deposition of material on the inside wall of the tube known as fouling. These deposits reduce the heat transfer rate across the wall of the tube and result in an increased pressure drop across the length of the tube. Further, these deposits can be relatively hard and, therefore, difficult to remove from the tube wall.

Various methods have been developed to clean the inside of a heat exchanger tube to remove these deposits. Most of these methods involve taking the heat exchanger off-line and out of service to manually clean the tubes. These manual methods of cleaning include: high pressure water cleaning to blast away the deposits, acid cleaning to loosen or dissolve the deposits, or the propulsion of a brush or scraping implement through the tube to scrape off the deposits.

All of these manual methods result in the loss of use of the heat exchanger during cleaning and incur the cost associated with the cleaning itself. Furthermore, after cleaning and during operation, the tubes begin to foul and continue fouling resulting in a reduction in heat transfer until the next cleaning. In the case of acid cleaning, pitting and corrosion of the tube my occur.

Other methods for cleaning the tubes without taking the heat exchanger out of service include devices which introduce a number of tube cleaners (e.g., balls or brushes) into the fluid which passes through the tubes. The tube cleaners are designed to fit tightly enough into the tube to contact the tube wall while still being pushed through the tube by the fluid pressure. At the outlet of the tube these tube cleaners are collected and recycled back to the tube inlet. In some systems the tube cleaners are propelled through the tube in a direction opposite the fluid flow by reversing the fluid flow temporarily. The number of tube cleaners used and the recycle rate may vary depending upon the cleaning effectiveness desired.

While these on-line systems avoid having to take the heat exchanger out of service, there is significant cost associated with the necessary piping and valving. Further, these methods are prone to plugging of the tube by debris that has been loosened by the tube cleaners.

After the tubes have been cleaned the pressure drop across the tube and the heat transfer rate across the tube wall return to their nominal design points. However, none of the on-line cleaning methods act to enhance the heat transfer rate across the tube wall.

In view of the foregoing, a need exists for an improved method of cleaning the inside of a heat exchanger tube and for enhancing the heat transfer rate across the tube wall.

SUMMARY OF THE INVENTION

A method and apparatus are described for cleaning the inside of a heat exchanger tube while the tube is in operation and for simultaneously enhancing the heat transfer across the tube wall. The method consists of positioning a rod containing a tube cleaner inside of a heat exchanger tube such that, during operation of the heat exchanger tube, fluid passing through the heat exchanger tube is deflected to create turbulence that improves the heat transfer associated with the heat exchanger tube and moving the rod in a back and forth motion during operation of the heat exchanger tube such that contact between the tube cleaner and the inside wall of the heat exchanger reduces the accumulation of particulate on said inside wall.

The method and apparatus described provide the benefit of cleaning a heat exchanger tube while it is in operation, thereby substantially reducing the need to take the heat exchanger out of service for cleaning. The method and apparatus described also provide the benefit of improving the heat transfer associated with the heat exchanger tube.

DESCRIPTION OF THE PREFERRED EMBODIMENT(S)

Figure 1:
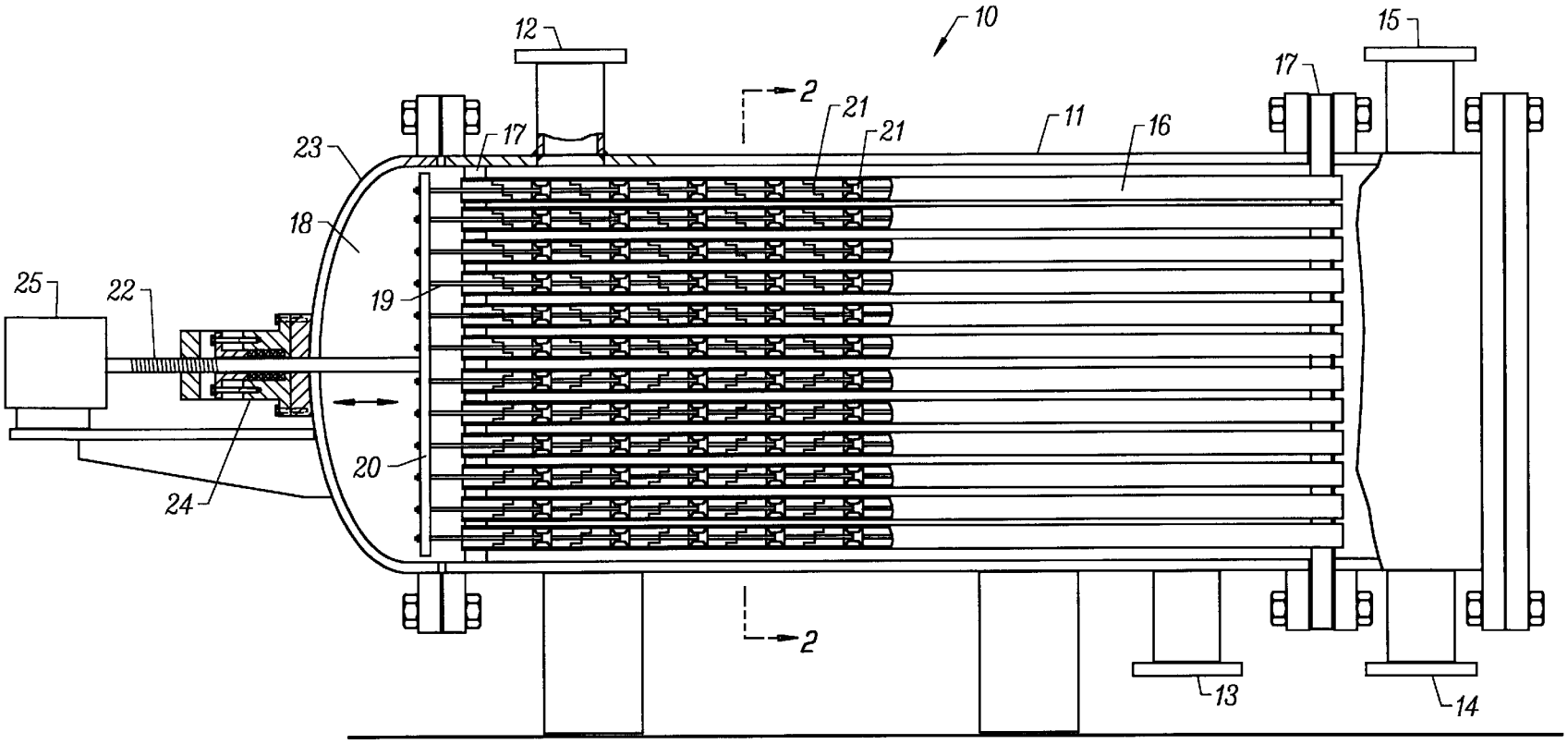
FIG. 1 is a cross sectional side view of an apparatus for cleaning a plurality of heat exchanger tubes contained in a heat exchanger and simultaneously improving the heat transfer rate across each tube wall in accordance with an embodiment of the present invention.

FIG. 1 shows shell and tube heat exchanger 10 for use with the present invention with shell cover 11, shell nozzles 12 and 13 and tube nozzles 14 and 15. Heat exchanger tubes 16 extend through tube sheet 17 into the water box 18. Rods 19 are attached to plate 20, located inside water box 18, and extend longitudinally through each tube 16. Tube cleaners 21 are fixedly attached to rods 19 as described below. Plate 20 is attached to shaft 22 which protrudes through channel cover 23, valve 24 and is attached to motor 25 which operates to move shaft 22 in a back and forth (left to right and right to left as shown in FIG. 1) motion. It should be appreciated that valve 24 may be any type of valve or device, such as a packing gland, that permits a shaft to move in a back and forth direction while providing a water tight seal to prevent fluid leakage from the structure to which the valve is attached and through which the shaft protrudes. It should also be appreciated that motor 25 may be any mechanical, pneumatic or hydraulic device for moving shaft 22 in a back and forth motion.

Figure 2:
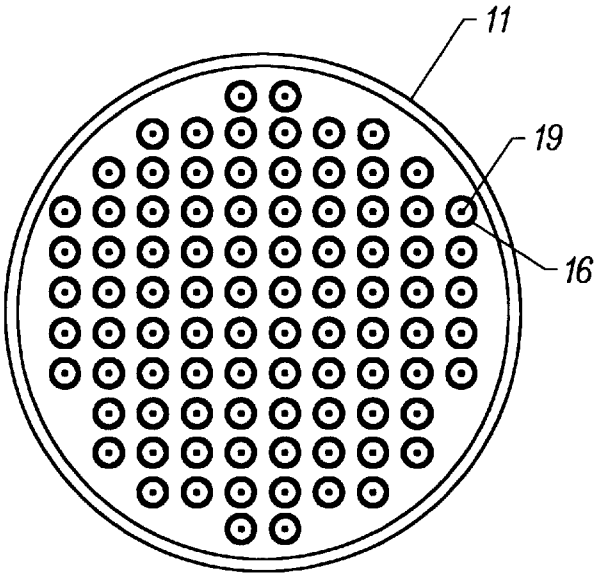
FIG. 2 is a cross sectional end view of the heat exchanger taken along the line 2—2 of FIG. 1.

FIG. 2 is a cross sectional end view of heat exchange 10 taken along the line 2—2 of FIG. 1. This FIG. 2 shows the rods 19 located within each tube 16.

Figure 3:
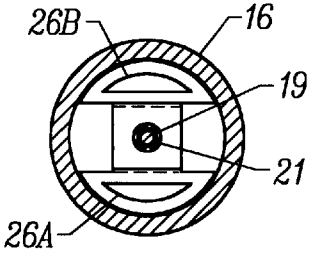
FIG. 3 is a end view of a single heat exchanger tube of FIG. 2.

FIG. 3 is an enlarged end view of a single tube 16 of FIG. 2. Rod 19 is positioned in the center of the tube 16. A tube cleaner 21 is fixedly attached to rod 19. The tube cleaner 21 includes fins 26A and 26B which are in intimate contact with the inside wall of tube 16.

Figure 4:
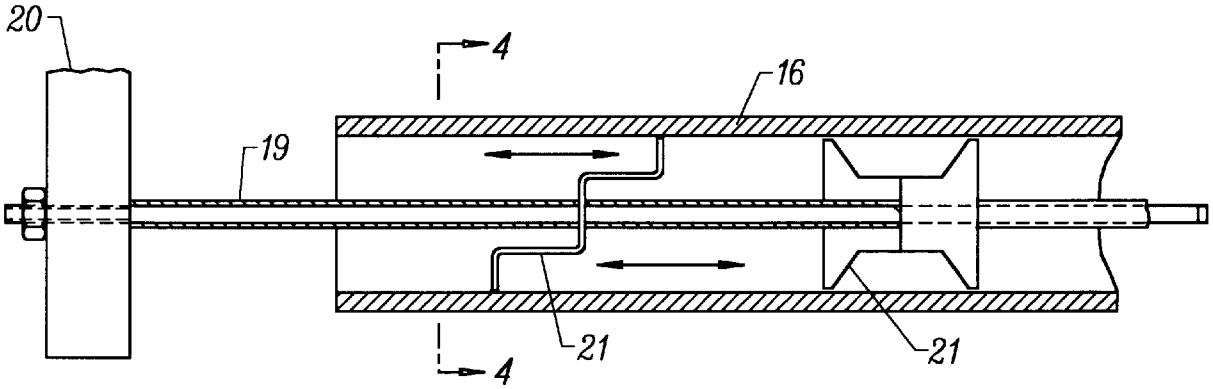
FIG. 4 is a cross sectional side view of a single heat exchanger tube of the apparatus of FIG. 1.

FIG. 4 is a cross sectional side view of an individual heat exchanger tube 16. Rod 19 is attached to plate 20 and passes through tube 16. Tube cleaners 21 are fixedly attached to rod 19 to prevent the tube cleaners 21 from moving either along rod 19 or rotating about rod 19. Tube cleaners 21 are also positioned about rod 19 such that each tube cleaner is radially offset by approximately 90° from each adjacent tube cleaner 21.

Figure 5:
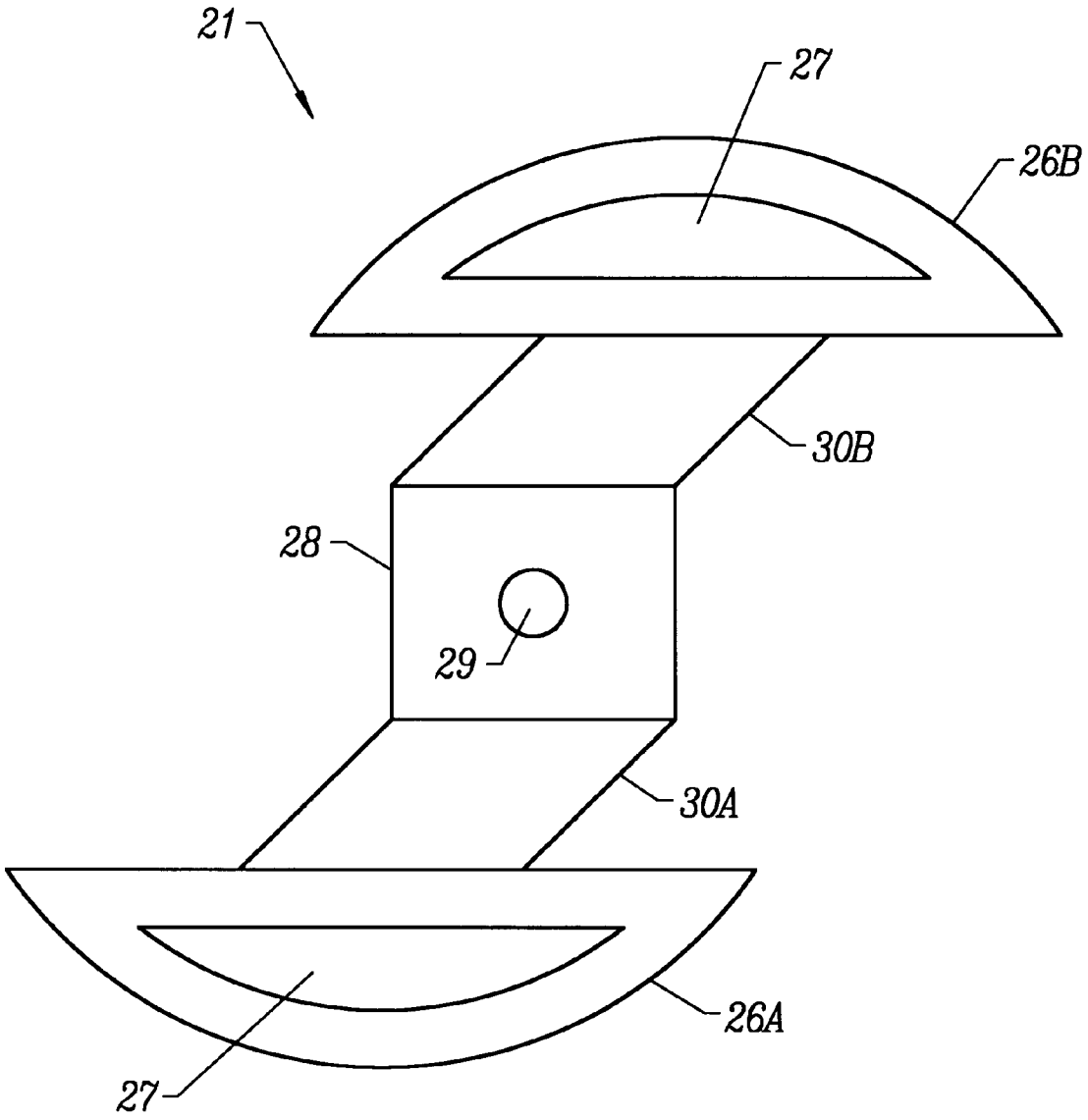
FIG. 5 is a perspective view of an individual tube cleaner used in accordance with an embodiment of the present invention.

FIG. 5 is a perspective view of tube cleaner 21. Generally, tube cleaner 21 is designed to minimize the pressure drop across the length of tube 16 and to enhance the heat transfer rate across the wall of tube 16. Tube cleaner 21 is comprised of a rod-connecting base 28 which is a substantially flat piece of corrosion resistant metal defining a hole 29 through which rod 19 is placed. Rod-connecting base 28 is fixedly attached to rod 19 by any method known in the art for connecting two such materials. The specific placement of tube cleaner 21 along rod 19 is described below. Attached to the opposite edges of rod-connecting base 28 are longitudinal surfaces 30A and 30B. Longitudinal surface 30A extends in a proximate direction, and longitudinal surface 30B extends in a distal direction. Longitudinal surfaces 30A and 30B are also made of a corrosion resistant metal and may be attached or integral to rod-connecting base 28. Fins 26A and 26B are attached in a substantially perpendicular position to longitudinal surfaces 30A and 30B, respectively. It should be appreciated that fins 26A and 26B may be attached or integral to longitudinal surfaces 30A and 30B. To minimize the pressure drop, fins 26A and 26B include aperatures 27 through which the fluid in tube 16 may pass more easily. Further, fins 26A and 26B of each individual tube cleaner 21 do not contact the entire inside diameter of tube 16 thereby defining additional spaces through which the fluid in tube 16 may pass more easily.

Fins 26A and 26B are also designed to promote turbulence along the inside wall of tube 16 to enhance the tube-side heat transfer coefficient and thereby improve the heat transfer rate across the wall of tube 16. Fins 26A and 26B may be made from a corrosion resistant metal and should be flexible enough to minimize the energy required by motor 25 to move rods 19 back and forth. However, fins 26A and 26B must be rigid enough to scrape deposits from the inside wall of tube 16. It should be appreciated that FIG. 5 is only one embodiment of tube cleaner 21. Other designs are possible that provide the same features of minimized pressure drop and enhanced heat transfer while cleaning the inside of tubes 16.

In operation and use, the method of the present invention comprises the steps of operating heat exchanger 10 so that fluid is passing through tubes 16, and operating motor 25 to move shaft 22 in a back and forth motion. In turn, shaft 22 pulls and pushes plate 20, which in turn pulls and pushes rods 19 through tubes 16. As rods 19 move, tube cleaners 21 also move thereby scraping and cleaning the inside walls of tubes 16.

It should be appreciated that tube cleaner 21 only scrapes a portion of the inside wall of tube 16, since the outer edge of fins 26A and 26B do not contact the entire circumference of the inside wall of tube 16. Further, tube cleaner 21 only cleans a given length of tube 16 equivalent to the distance that rod 19 is moved back and forth. Therefor, the entire inside wall of tube 16 is cleaned by the combination of adjacent tube cleaners 21 being oriented 90° from each other and being moved back and forth into a section of tube 16 that overlaps with another section of tube 16 cleaned by an adjacent tube cleaner 21. Therefore, the distance between the tube cleaners 21 is defined by the total back and forth distance that plate 21 can be moved to provide complete cleaning of the inside wall of tubes 16.

It should be appreciated that as fins 26A and 26B are moved back and forth to scrape the inside wall of tube 16, turbulence is created in the fluid moving along the inside wall of tube 16 and generally in the bulk of the fluid. Furthermore, fins 26A and 26B are designed to promote turbulence even when they are stationary. This turbulence results in an enhanced tube-side heat transfer coefficient which improves the heat transfer rate across the wall of tube 16. The following example calculations show the possible magnitude of improvement in the heat transfer rate across the wall of tube 16 by use of the invention.

Assuming the heat exchanger has 1 in. outer diameter tubes with 0.049 in. thick wall. The inner diameter of a tube is:

$$1-2\times0.049=0.902 \text{ in.}$$

The internal flow area of the tube is:

$$A_1 = \frac{\pi}{4}\times(0.902)^2 = 0.639 \text{ in.}^2$$

Assuming the outer diameter of the rod is 0.375 in., the net flow area with the invention is:

$$A_2 = A_1 - \frac{\pi}{4}\times(0.375)^2 = 0.5286 \text{ in.}^2$$

Velocity inside the tube is inversely proportional to the flow area:

$$\frac{V_2}{V_1} = \frac{A_1}{A_2}\frac{0.639}{0.5286} = 1.21$$

Therefore, the velocity inside the tube with the invention is increased by 21%. The inside heat transfer is directly proportional to the velocity increase:

$$\frac{h_2}{h_1} = \left(\frac{V_2}{V_1}\right)^{0.8} = (1.21)^{0.8} = 1.164$$

Hence the inside heat transfer coefficient is increased by 16.4% with the invention. In addition, the invention also induces additional turbulence estimated to be 30%. Therefore, the overall inside heat transfer coefficient increase is:

$$1.164\times1.3=1.51 \text{ or } 51\%.$$

While the above apparatus and method were described for use with the heat exchanger shown in FIG. 1, it should be appreciated that the apparatus and method described above may be used with any type of heat exchanger or for cleaning the inside of any type of tube. Further, it should be appreciated that while the apparatus and method described above can be utilized to clean all of the heat exchanger tubes simultaneously, it is possible to utilize the above apparatus and method for a lesser number of tubes in a given heat exchanger.

As described above, the operation of an apparatus that moves tube cleaners in a back and forth motion in the tube of a heat exchanger provides the ability to clean the heat exchanger tubes without taking the heat exchanger out of operation and simultaneously improving the heat transfer rate across the heat exchanger tube walls.

I claim:

1. An apparatus for on-line cleaning of, and improvement of heat transfer in, a heat exchanger tube comprising:

a heat exchanger tube having an inside wall;

a rod positioned longitudinally inside of said heat exchanger tube;

at least one tube cleaner fixedly attached to said rod and in contact with said inside wall of said heat exchanger tube, said tube cleaner including a pair of longitudinally offset scraping fins, each scraping fin with an aperture defined therein; and a motion device to drive said rod in a back and forth motion in said heat exchanger tube while said heat exchanger tube is in operation such that said tube cleaner reduces the accumulation of particulate on said inside wall and creates turbulence to improve heat transfer associated with said heat exchanger tube.

2. The apparatus of claim 1 wherein said rod includes a plurality of tube cleaners fixedly attached to said rod and positioned along its longitudinal length, each of said tube cleaners including a scraping fin with an aperture defined therein.

3. The apparatus of claim 2 wherein said scraping fin of each of said tube cleaners is radially offset from said scraping fins of adjacent tube cleaners.

4. An apparatus for on-line cleaning of, and improvement of heat transfer in, a heat exchanger tube comprising:

a heat exchanger tube having an inside wall;

a rod positioned longitudinally inside of said heat exchanger tube;

at least one tube cleaner fixedly attached to said rod and in contact with said inside wall of said heat exchanger tube, wherein said tube cleaner comprises a rod-connecting base having a top edge, a bottom edge opposite said top edge and an opening through which said rod may pass, a proximate longitudinal surface attached to said top edge of said rod-connecting base and extending substantially in a proximate longitudinal direction, a distal longitudinal surface attached to said bottom edge of said rod-connecting base and extending substantially in a distal longitudinal direction, a first fin attached substantially perpendicular to said proximate longitudinal surface and having an aperture through which fluid may pass and an edge substantially forming an arc to contact said inside wall, and a second fin attached substantially perpendicular to said distal longitudinal surface and having an aperture through which fluid may pass and an edge substantially forming an arc to contact said inside wall; and a motion device to drive said rod in a back and forth motion in said heat exchanger tube while said heat exchanger tube is in operation such that said tube cleaner reduces the accumulation of particulate on said inside wall and creates turbulence to improve heat transfer associated with said heat exchanger tube.

5. An apparatus for on-line cleaning of, and improvement of heat transfer in, a heat exchanger comprising:

a heat exchanger having a heat exchanger first end and having a plurality of heat exchanger tubes, each having an inside wall and a heat exchanger tube first end located at said heat exchanger first end, said heat exchanger configured to hold a first fluid outside of said plurality of heat exchanger tubes, and a second fluid inside of said plurality of heat exchanger tubes;

a plurality of rods, each having a first rod end and separately positioned longitudinally inside of each of said heat exchanger tubes with said first rod ends protruding out of said heat exchanger tube first ends of said heat exchanger tubes;

at least one tube cleaner fixedly attached to each of said rods and in contact with said inside walls, each tube cleaner including a pair of longitudinally offset scraping fins, each scraping fin with an aperture defined therein;

a plate connected to each of said rods; and a motion device connected to said plate to drive said plate in a back and forth motion while said heat exchanger tubes are in operation such that said rods are driven in a back and forth motion inside said heat exchanger tubes such that said tube cleaners reduce the accumulation of particulate on said inside walls and create turbulence to improve heat transfer associated with said heat exchanger tubes.

6. The apparatus of claim 5 wherein said rods include a plurality of tube cleaners fixedly attached to said rods and positioned along their longitudinal length, each of said tube cleaners including a scraping fin with an aperture defined therein.

7. The apparatus of claim 6 wherein said scraping fin of each of said tube cleaners is radially offset from said scraping fins of adjacent tube cleaners.

8. An apparatus for on-line cleaning of, and improvement of heat transfer in, a heat exchanger comprising:

a heat exchanger having a heat exchanger first end and having a plurality of heat exchanger tubes, each having an inside wall and a heat exchanger tube first end located at said heat exchanger first end;

a plurality of rods each having a first rod end and separately positioned longitudinally inside of each of said heat exchanger tubes with said first rod ends protruding out of said heat exchanger tube first ends of said heat exchanger tubes;

at least one tube cleaner fixedly attached to each of said rods and in contact with said inside walls wherein said tube cleaner comprises a rod-connecting base having a top edge, a bottom edge opposite said top edge and an opening through which said rod may pass, a proximate longitudinal surface attached to said top edge of said rod-connecting base and extending substantially in a proximate longitudinal direction, a distal longitudinal surface attached to said bottom edge of said rod-connecting base and extending substantially in a distal longitudinal direction, a first fin attached substantially perpendicular to said proximate longitudinal surface and having an aperture through which fluid may pass and an edge substantially forming an arc to contact said inside wall, and a second fin attached substantially perpendicular to said distal longitudinal surface and having an aperture through which fluid may pass and an edge substantially forming an arc to contact said inside wall;

a plate connected to each of said rods; and a motion device connected to said plate to drive said plate in a back and forth motion while said heat exchanger tubes are in operation such that said rods are driven in a back and forth motion inside said heat exchanger tubes such that said tube cleaners reduce the accumulation of particulate on said inside walls and create turbulence to improve heat transfer associated with said heat exchanger tubes.

* * * * *